US010793975B2

(12) United States Patent
Brüning et al.

(10) Patent No.: US 10,793,975 B2
(45) Date of Patent: Oct. 6, 2020

(54) MONOFILAMENTS HAVING HIGH ABRASION RESISTANCE AND DIMENSIONAL STABILITY AND LOW SLIDE FRICTION, TEXTILE FABRICS COMPOSED THEREOF AND USE THEREOF

(71) Applicant: Perlon Nextrusion Monofil GmbH, Bobingen (DE)

(72) Inventors: Hans-Joachim Brüning, Augsburg (DE); Ralf Haber, Wehringen (DE); Pascal Heckenbenner, Augsburg (DE)

(73) Assignee: Perlon Nextrusion Monofil GmbH, Bobingen (DE)

( * ) Notice: Subject to any disclaimer, the term of this patent is extended or adjusted under 35 U.S.C. 154(b) by 0 days.

(21) Appl. No.: 15/310,804

(22) PCT Filed: May 11, 2015

(86) PCT No.: PCT/EP2015/000969

§ 371 (c)(1),
(2) Date: Nov. 14, 2016

(87) PCT Pub. No.: WO2015/192932

PCT Pub. Date: Dec. 23, 2015

(65) Prior Publication Data

US 2017/0089010 A1 Mar. 30, 2017

(30) Foreign Application Priority Data

Jun. 20, 2014 (DE) ..... 10 2014 009 238

(51) Int. Cl.

| | |
|---|---|
| ***D01F 6/92*** | (2006.01) |
| ***D21F 7/08*** | (2006.01) |
| ***D01F 1/10*** | (2006.01) |
| ***D21F 1/00*** | (2006.01) |
| ***D01F 6/70*** | (2006.01) |

(52) U.S. Cl.
CPC ..... *D01F 6/92* (2013.01); *D01F 1/10* (2013.01); *D01F 6/70* (2013.01); *D21F 1/0027* (2013.01); *D21F 7/08* (2013.01)

(58) Field of Classification Search
CPC ..... D01F 6/92; D01F 6/94; D01F 6/96; D01F 6/62; D01F 6/625; D01F 6/64; C08L 69/005
See application file for complete search history.

(56) References Cited

U.S. PATENT DOCUMENTS

| | | | | |
|---|---|---|---|---|
| 5,635,298 | A | 6/1997 | Delker | |
| 5,652,057 | A | 7/1997 | Delker | |
| 5,700,881 | A * | 12/1997 | Wagner | C08L 67/02 428/395 |
| 6,254,987 | B1 | 7/2001 | Delker | |
| 2006/0058441 | A1* | 3/2006 | Delker | D01F 1/10 524/430 |
| 2007/0015883 | A1* | 1/2007 | Hale | C08L 67/02 525/439 |
| 2007/0219323 | A1* | 9/2007 | Bruning | D01F 6/92 525/444 |
| 2009/0209695 | A1 | 8/2009 | Yu et al. | |
| 2011/0196098 | A1 | 8/2011 | Mettlach et al. | |

FOREIGN PATENT DOCUMENTS

| | | | |
|---|---|---|---|
| DE | 4410399 | A1 | 9/1995 |
| DE | 19511852 | A1 | 10/1996 |
| DE | 19511853 | A1 | 10/1996 |
| DE | 102004041755 | A1 | 3/2006 |
| DE | 102006012048 | A1 | 9/2007 |
| EP | 0387395 | A2 | 9/1990 |
| EP | 0976854 | A1 | 2/2000 |
| JP | H07216647 | A | 8/1995 |
| JP | 2006063511 | A | 3/2006 |
| JP | 2007247131 | A | 9/2007 |
| WO | 2009021967 | A1 | 2/2009 |

OTHER PUBLICATIONS

Japanese Official Action dated Mar. 6, 2019.

* cited by examiner

*Primary Examiner* — Jennifer A Steele
(74) *Attorney, Agent, or Firm* — Michael Ferrell

(57) ABSTRACT

Monofilaments having high abrasion resistance and dimensional stability and low slide friction, textile fabrics composed thereof and use thereof Disclosed is a polyester monofilament comprising a) 60 to 85 wt.-% of a polyester raw material selected from the group of polyethylene terephthalate, of polyethylene naphthalate, of to polyethylene terephathalate modified with dicarboxylic acid, of polyethylene naphthalate modified with dicarboxylic acid, or of combinations thereof, b) 14.4 to 30 wt.-% of a thermoplastic elastomeric block copolymer, c) 0.05 to 10 wt.-% of a polycarbonate, and d) 0.1 to 10 wt.-% of a carbodiimide stabilizer, wherein the quantities are based on the total amount of the monofilament.

The disclosed monofilaments can be preferably used for the manufacture of paper machine clothing and are distinguished by high hydrolytic stability, abrasion resistance and dimensional stability as well as by a very low slide friction.

22 Claims, No Drawings

MONOFILAMENTS HAVING HIGH ABRASION RESISTANCE AND DIMENSIONAL STABILITY AND LOW SLIDE FRICTION, TEXTILE FABRICS COMPOSED THEREOF AND USE THEREOF

CLAIM FOR PRIORITY

This application is a national phase application of PCT/EP2015/000969 FILED May 11, 2015 which was based on application DE 10 2014 009238.0 FILED Jun. 20, 2014. The priorities of PCT/EP2015/000969 and DE 10 2014 009238.0 are hereby claimed and their disclosures incorporated herein by reference.

TECHNICAL FIELD

The present invention relates to a monofilament that can be used for the production of textile fabrics, which can be used especially in hot, humid environments with high mechanical stress. The textile fabrics made from the monofils of the invention can be preferably used as a cylindrical sieve for porous paper machine clothings. These are especially preferred used in the sheet formation part of paper machines.

BACKGROUND

The backing of forming screens used in the sheet formation part of paper machines is exposed to increased wear because of the pressure conditions prevailing in this section (suction boxes). Therefore, at the bottom of these screens previously alternating monofilaments made of polyethylene terephthalate (hereinafter called "PET") and made of polyamide have been used. This combination has proved to be more abrasion resistant compared to pure PET. The disadvantage of this approach is that by the higher water absorption of the polyamide the weft material of the fabric expands. This results in an undesired raising of the edges of the screen in the border area of the screen ("edge-curling").

DE 10 2004 041755 A1 discloses fibers containing aliphatic-aromatic polyester and spherical particles of inorganic oxides with an average diameter of less than or equal to 100 nm. In this document it is disclosed that the abrasion resistance of the fibers described therein can be improved by the addition of polycarbonate. The use of thermoplastic elastomeric copolymers is not disclosed.

EP387 395 A2 describes monofilaments consisting of a mixture of 60 to 90% PET, 10% to 40% thermoplastic polyurethane elastomer (hereinafter called "TPU") and of up to 5% carbodiimide. These monofilaments, inserted into the back weft, avoid the edge curling. Merely at the offset points with the warp a slight flattening due to the softer material appears. This affects the drainage performance of the forming sieve in the paper machine.

DE 4,410,399 A1 bypasses this problem by using a modified PET with a lower melting point which is in the range of 200 to 230° C. A different approach is referred to in DE 19,511,852 A1 in that the TPU is replaced by a thermoplastic polyester elastomer (hereinafter called "TPE-E"), which is spun together with unmodified PET.

DE 10 2006 012048 A1 discloses melt-spun polyester threads containing a combination of thermoplastic and elastic copolyesters and of thermoplastic polyester copolymers derived from different dicarboxylic acids or from their polyester-forming derivatives. These threads are characterised by a very good abrasion resistance and at the same time by a high dimensional stability.

The aforementioned abrasion-resistant monofilaments with thermoplastic elastomers as a component all have the disadvantage, that due to the presence of soft segments in the thermoplastic elastomers, which have been used in the wefts, these wefts strongly flatten in the offset points of the fabric, which results in a reduced drainage performance of the screens.

DE 19,511,853 A1 solves this problem in part, in that the monofilament consists of a core made of PET and of a sheet consisting of a mixture of TPE-E and of modified PET. After extended operation, the sheet material is however abraded and the core made of PET is exposed and is open to wear.

SUMMARY OF INVENTION

It has been found that the monfilaments of the invention exhibit a surprisingly low slip resistance and allow a significant reduction in the driving power of the machine, typically a reduction of more than 10% compared to screens made of conventional monofilaments.

An objective of this invention is the provision of a combination of materials which shows a high stability in hot, humid environments, has a low slip resistance, as well as on the one hand has very good abrasion resistance and on the other hand is extremely dimensional stable, so that the edge-curling as well as the flattening of the offset points is largely avoided.

This objective is solved by providing monofilaments, which are made of a mixture of selected components.

The present invention thus relates to a polyester monofilament containing a) 60 to 85 wt.-% of a polyester raw material selected from the group of polyethylene terephthalate, of polyethylene naphthalate, of polyethylene terephathalate modified with dicarboxylic acid, of polyethylene naphthalate modified with dicarboxylic acid, or of combinations thereof, b) 14.4 to 30 wt.-% of a thermoplastic elastomeric block copolymer, c) 0.05 to 10 wt.-% of a polycarbonate, and d) 0.1 to 10 wt.-% of a carbodiimide stabilizer, wherein the quantities are to based on the total amount of the monofilament.

It has become apparent that the polymer mixture is cross-linked through the added polycarbonate. This results in an improvement of dimensional stability of the monofilament prepared therefrom. It is particularly surprising that the cross-linking can be increased still more by adding carbodiimide.

As a polyester of component a) according to the invention polyethylene-terephthalate- and/or polynaphthylene-terephtalate-raw materials are used, which after spinning, stretching and optionally relaxing result in monofilaments with the profile of properties mentioned above These are polyethylene terephthalate- or polyethylene naphthalate-homopolymers or polyethylene terephthalate- or polyethylene naphthalate-units containing copolymers. These polymers therefore are derived from ethylene glycol and from terephthalic acid, naphthalene dicarboxylic acid or their polyester-forming derivatives, such as from the dicarboxylic acid esters or -chlorides and optionally from other dicarboxylic acids or their polyester-forming derivatives.

These thermoplastic polyesters are known per se. Building blocks of thermoplastic copolyesters a) are the aforementioned ethylene glycol as well as the aforementioned dicarboxylic acids or their correspondingly structured polyester-forming derivatives. Main components of the polyesters of component a) are besides ethylene glycol, terephthalic acid and/or naphthalene dicarboxylic acid, optionally together with lower amounts, preferably with up to 30 mol-%, referring to the total amount of dicarboxylic acids, of other aromatic and/or aliphatic and/or cycloaliphatic dicarboxylic acids, preferably with aromatic compounds, such as phthalic acid, 4,4'-biphenyl dicarboxylic acid, or in particular isophthalic acid and/or with aliphatic dicarboxylic acids, such as adipic acid or sebacic acid.

In addition to the ethylene glycol lower amounts of suitable dihydric alcohols can be used, for example up to 30 mol-%, referring to the total amount of alcohols. Typical examples of these are aliphatic and/or cycloaliphatic diols, such as propanediol, 1,4-butanediol, cyclohexanedimethanol or mixtures thereof.

Examples of preferred components a) are copolyesters, that have additional units besides polynaphthalate units, which units are derived from alkylene glycols, in particular from ethylene glycol, and from aliphatic and/or aromatic dicarboxylic acids, such as adipic acid, sebacic acid, terephthalic acid or isophthalic acid.

Preferably used components a) are polyethylene terephthalate or a polyethylene terephthalate modified with dicarboxylic acid, in particular a polyethylene terephthalate modified with aromatic dicarboxylic acid or a polyethylene terephthalate modified with aliphatic dicarboxylic acid.

Particularly preferred components a) are polyethylene terephthalate modified with aromatic dicarboxylic acid, in particular polyethylene terephthalate modified with isophthalic acid, or polyethylene terephthalate modified with phthalic acid.

Likewise particular preferred components a) are polyethylene terephthalate modified with aliphatic dicarboxylic acid, preferably polyethylene terephthalate modified with adipic acid or polyethylene terephthalate modified with sebacic acid.

The polyesters of component a) used according to the invention in general have solution viscosities (IV values) of at least 0.60 dl/g, preferably of 0.60 to 1.05 dl/g, particularly preferred of 0.62 to 0.93 dl/g, (measured at 25° C. in dichloroacetic acid (DCE)).

The thermoplastic and elastomeric block copolymers of component b) can be selected among a wide variety of types. Such block copolymers are known to the skilled artisan.

Examples of components b) are thermoplastic and elastomeric polyurethanes (TPE-U), thermoplastic and elastomeric polyesters (TPE-E), thermoplastic and elastomeric polyolefins (TPE-O) and thermoplastic and elastomeric styrene block copolymers (TPE-S).

The thermoplastic and elastomeric block copolymers b) can be constructed from a wide variety of monomer combinations. Usually these are blocks from so-called hard and soft segments. Typically for the TPE-U and TPE-E the soft segments are derived from poly alkylene glycol ethers. Typically for the TPE-U and TPE-E the hard segements are derived from short-chain diols or diamines. Besides the diols or diamines the hard and soft segments are composed of aliphatic, cycloaliphatic and/or aromatic dicarboxylic acids or diisocyanates.

Examples of thermoplastic polyolefins are block copolymers comprising blocks made of ethylene-propylene-butadiene and of polypropylene (EPDM/PP) or made of nitrile-butadiene and polypropylene (NBR/PP).

Examples of thermoplastic and elastomeric styrene block copolymers are block copolymers comprising blocks made of styrene-ethylene and of propylene-styrene (SEPS) or made of styrene-ethylene and of butadiene-styrene (SEBS) or made of styrene and of butadiene (SBS).

Thermoplastic and elastomeric block copolymers are to be understood in the context of this disclosure as block copolymers that behave at room temperature comparable to the classic elastomers, but that plastically deform under heat input and thus show a thermoplastic behavior. These thermoplastic and elastomeric block copolymers have in partitions physical crosslinking points (for example, partial valency forces or crystallites) that dissipate in heat, without that the polymer molecules decompose.

Polyester monofilaments are preferred containing as component b) a thermoplastic polyester elastomer.

Preferred as component b) are copolyesters containing recurring structural units, which are derived from an aromatic dicarboxylic acid and from an aliphatic diol and from a polyalkylene glycol.

Preferably used thermoplastic polyester elastomers b) comprise recurring structural units which are derived from terephtalic acid, ethylene glycol and polyethylene glycol, from terephthalic acid, butylene glycol and polyethylene glycol, from terephthalic acid, butylene glycol, and polybutylene glycol, from naphthalene dicarboxylic acid, ethylene glycol and polyethylene glycol, from naphthalene dicarboxylic acid, butylene glycol and polyethylene glycol, from naphthalene dicarboxylic acid, butylene glycol, and polybutylene glycol, from terephtalic acid, isophthalic acid, ethylene glycol and polyethylene glycol, from terephthalic acid, isophthalic acid, butylene glycol and polyethylene glycol, and from terephthalic acid, isophtalic acid, butylene glycol, and polybutylene glycol.

In particular as components b) block copolymers containing polybutylene terephthalate blocks and polyethylene glycol terephthalate blocks are used.

Polymers of component b) are commercially available, such as Hytrel® (DuPont/US), Heraflex® (Radicinovacips/IT) E, Arnitel® (DSM Engineering Plastics/NL) or Keyflex® (LG Chemical/KR).

Polycarbonates are used as component c). These are plastics from the polyester group, specifically from the group of polymeric esters of carbonic acid with bivalent alcohols. Preferably polycarbonates are used, which are derived from Bisphenols, in particular from 2,2-Bis(4-hydroxyphenyl)-propane (Bisphenol A). Polycarbonates are marketed under the trade names Makrolon® (Bayer) or Lexan® (Sabic).

As an alternative to the polycarbonates derived from Bisphenol A also such types are marketed, which are derived from Bisphenol S, from tetramethyl bisphenol A or from 1,1-bis(4-hydroxyphenyl)-3,3,5-trimethylcyclohexane (BPTMC). Polycarbonates are generally amorphous and have a crystallite portion of less than 5%. They are characterized by high strength, impact resistance, stiffness and hardness. Polycarbonates are largely resistant to the influences of weather and radiation.

Polyester monofilaments are preferred, which contain as component c) a polycarbonate, that is derived from bisphenols, in particular from Bisphenol A.

The polyester monofilaments of the invention are stabilized by carbodiimide. This is added as component d) to the spinnable mass.

Preferably, polyester monofilaments are produced containing a content of free carboxyl groups of less than 10 mval/kg, preferably less than or equal to 5 mval/kg, in particular less than or equal to 2 mVal/kg.

This is obtained by the addition of component d) which representes a means to the closure of free carboxyl groups.

Such equipped polyester monofilaments are stabilized against hydrolytic degradation and are particularly suited for use in hot, humid environments, e.g. in paper machines or as a filter.

Particularly preferred as component d) are polymeric carbodiimides.

Carbodiimides are marketed under the trade name Stabaxol® (Rheinchemie).

The quantities of components a), b), c) and d) in the polyester monofilaments of the invention can be selected in the ranges specified above.

The portion of component a) in the polyester monofilaments of the invention is typically 60 to 85 wt.-%, preferably 65 to 80 wt.-%, and particularly preferred 70 to 80 wt.-%, referring to the total amount of the monofilament.

The portion of the component b) in the polyester monofilaments of the invention is typically 14.4 to 30 wt.-%, preferably 15 to 25 wt.-%, and particularly preferred 20 to 25 wt.-%, referring to the total amount of the monofilament.

The portion of component c) in the polyester monofilaments of the invention is typically 0.05 to 10 wt.-%, preferably 0.1 to 3 by wt.-%, in particularly preferred 0.5 to 3 wt.-% and most preferred 0.5 to 1.5 wt.-%, referring to the total amount of the monofilament.

The portion of component d) in the polyester monofilaments of this invention is typically 0.1 to 10 wt.-%, preferably 0.3 to 4.5 wt.-%, referring to the total amount of the monofilament.

Typically, the monofilaments contain 60-85 wt.-% of component a), 14.4 to 30 wt.-% of component b), 0.05 to 10 wt.-% of component c %) and 0.1 to 10 wt.-% of component d), each based on the total amount of the monofilament.

Particularly preferred are polyester monofilaments which contain component a) in an amount of 70 to 80 wt.-%, component b) in an amount of 20 to 25 wt.-%, component c) in an amount of 0.5 to 3 wt.-% and component d) in an amount of from 0.3 to 4.5 wt.-%.

Very particularly preferred the monofilament of the invention comprises 70.5 79.1 wt.-% of a PET modified with 10 to 15 wt. 12% of isophthalic acid, 20 to 25 wt.-% of TPE-E, 0.5 to 2.5 wt.-% of polycarbonate and 0.4 to 4.5 wt.-% of polymeric carbodiimide.

DETAILED DESCRIPTION

The combination of components a), b), c) and d) used according to the invention awards to the threads in addition to an excellent abrasion resistance good textile technological properties, in particular a very low slide friction and a high dimensional stability combined with an excellent hydrolysis restistance. Especially the very good values for the abrasion resistance and for the low slide resistance were not to be expected for the skilled artisan.

The selection of components a) to d) is carried out by the skilled artisan on an individual basis. So, components a) to d) must be selected in a manner, that their processing can be performed at temperatures in which none of the components is subject to a significant decomposition.

In addition to the above described components a) to d) the polyester monofilament of the invention may contain additional and common additives e). The amount of such components e) is typically 0.001 to 10 wt.-%, based on the total amount of the monofilament.

Examples of common additives e) are antioxidants, UV stabilizers, fillers, pigments, biocides, additives to increase the electrical conductivity, additives for improved abrasion resistance, friction reducing additives, avivages, processing aids, plasticizers, lubricants, matting agents, viscosity modification agents, cristallization accelerators or combinations of two or more of them.

The components a), b), c), d) and e) needed for the production of the threads of the invention are known per se, some are commercially available or can be made by known procedures.

The yarn count of the monofilaments of the invention can vary widely. Examples of this are 50 to 45,000 dtex, especially 100 to 4,000 dtex.

The cross-sectional shape of the monofilaments of the invention can be arbitrary, such as round, oval or n-square, where n is greater than or equal to 3.

The monofilaments of the invention can be produced according to known procedures.

A typical manufacturing process includes the measures:

i) mixing of components a), b), c) and d) or of component a) and a masterbatch containing components b), c) and d) in an extruder,
ii) extruding the mixture containing components a), b), c) and d) through a spinneret,
iii) detracting of the formed monofilament
iv) optionally stretching and/or relaxing of the monofilament, and
v) winding of the monofilament.

One or more of the components b), c) and d) can be used in the form of a master batch. So, in particular the carbodiimide can be well dosed as a master batch in polyester and mixed into the components of a), b) and c). Also, component b) can be preferably mixed into the components a), c) and d) in the form of a master batch.

The monofilaments of the invention are one or several times stretched during their formation.

Especially preferred as component a) for the production of monofilaments is a polyester raw-material produced by solid phase condensation.

After melting and pressing of the polymer melt through a spinneret, the hot polymer thread is cooled down, preferably in a water bath, and is then stretched one or several times, is optionally fixed and rewound, as it is known from the prior of art for the aforesaid melt-spun polyesters.

Preferably the monofilaments of the invention are used for the production of textile fabric constructions, in particular of fabrics, spiral cloth, laid fabrics or knittings. These textile fabric constructions are preferably used in screens.

The invention therefore relates also to a textile fabric containing the monofilaments described above, especially a textile fabric in the form of a fabric, knitting, knitted fabric, mesh fabric or laid fabric.

The monofilaments of the invention can be used in all industrial fields. Preferably they are used in applications, where increased wear and high mechanical stress in hot, humid environments is to be expected. Examples of this are the use in screen fabrics and filter cloths for gas and liquid filters, in drying belts, for example, for the production of food or in particular of paper.

The invention also relates to the use of the above described polyester monofilaments as paper machine clothing, in conveyor belts and as filtration screens.

Preferably the above described polyester monofilaments are employed as paper machine clothing in the sheet formation part and/or in the dryer section of the paper machine.

The present invention is described in more detail by the following examples. These examples serve only to explain the invention and are not to be regarded as a constriction.

EXAMPLES 1-3

Starting raw material was a polyethylene terephthalate modified in the polycondensation with 12 wt.-% of isophthalic acid and with 88 wt.-% terephthalic acid (PET-type 153 from Invista Resins & Fibres GmbH, Hattersheim). To 75.5 wt.-% of the raw material 20.0 wt.-% of a polyester elastomer (TPE-E type E3918 from Heraflex), 4.0 wt.-% of dicarbodiimide (stabilizer KE 9464 from Rheinchemie) and 0.5 wt.-% of polycarbonate (Makrolon® 2458 from Bayer) were dosed gravimetrical immediately before the extruder.

The polymeric mixture was molten in the extruder at 250° C. to 270° C., pressed by a gear pump into a spinning pack and then spun into a water bath of 68° C. This was followed by a multiple stretching under heat with thermosetting and then with winding of the monofilaments.

The monofilaments of examples 2 and 3 were produced analogous to example 1.

Composition and the textile values of the obtained monofilaments are specified in table 1 below. The machine data for the production of the monofilament of example 3 are indicated in table 2 below.

TABLE 1

| | monofil example 1 | monofil example 2 | monofil example 3 |
|---|---|---|---|
| diameter (mm) | 0.352 | 0.350 | 0.350 |
| PET-type 153 (wt.-%) | 75.5 | 70.5 | 75.2 |
| TPE-E type E3918 (wt.-%) | 20.0 | 25.0 | 20.0 |
| stabilizer KE 9464 (wt.-%) | 4.0 | 4.0 | 4.0 |
| Makrolon 2458 (wt.-%) | 0.5 | 0.5 | 0.8 |
| yarn count (dtex) | 1238 | 1248 | 1237 |
| spec. tenacity (cN/tex) | 19.5 | 17.8 | 20.7 |
| elongation at break (%) | 76.1 | 115.6 | 65.9 |
| reference extension at 15 cN/tex (%) | 47.0 | 93.6 | 33.3 |
| reference extension at 20 cN/tex (%) | 79.8 | — | 60.5 |
| thermoshrinkage 160° C./30' (%) | 6.25 | 6.8 | 5.66 |
| thermoshrinkage 180° C./30' (%) | 12.8 | 13.9 | 10.4 |
| secant modulus (GPa) | 4.8 | 4.3 | 5.3 |
| Young-modulus (kg/mm$^2$) | 489.5 | 438.9 | 546.0 |
| knot strength (cN/tex) | n.b. | n.b. | n.b. |
| loop strength (cN/tex) | n.b. | n.b. | n.b. |
| max. shrinking force (° C./cN) | 164/24.91 | 70/16.7 | 173/33.3 |
| shrinkage at 180° C. (%) | 3.67 | −1.1 | 4.8 |
| spec. viscosity in dichloroacetic acid | 1163 | 1159 | n.b. |

TABLE 2

| Machine data for the monofil of example 3 | |
|---|---|
| stock temperature extruder | 245-256° C. |
| stock temperature spinning pack | 253° C. |
| pressure at spinning pack | 8.8 MPa |
| water temperatures | |
| spinning bath | 68° C. |
| stretching bath 1 | 90° C. |
| stretching bath 2 | 90° C. |
| air temperature fixing channel | 225° C. |
| stretching ratios | |
| stretching unit 4:stretching unit 1 | 3.869:1 |
| stretching unit 4:stretching unit 2 | 1.0714:1 |

TABLE 2-continued

| Machine data for the monofil of example 3 | |
|---|---|
| stretching unit 4:stretching unit 3 | 0.938:1 |
| velocity stretching unit 4 | 150.1 m/min |

COMPARISON EXAMPLES OF V1 TO V8 AND EXAMPLES 4 to 6

Testing of Abrasion Resistance

Monofilaments were prepared analogous as described in example 1. Composition and quantities of components used in the production, as well as the abrasion values determined for these monofilaments are listed in the following table 3. Polymer throughput and stretching were chosen in a manner, so that monofilaments with a diameter of 0.25 mm were obtained.

These monofilaments have been tested as 100% in the back weft of multi-layer forming webs of identical construction. The abrasion test was performed in 2000 in an analyzer Einlehner AT 2000. The following test conditions have been used:

suspension used: 1% $CaCO_3$ (Omya HC40BG) in 99% water not tempered, at the beginning of the test about 25° C.

friction body: $Al_2O_3$ wrap angle: 180° run length: 25,000 m prestretching weight: 2000 g fabric strip width: 25 mm

The decrease of the web thickness in μm is indicated as abrasion.

TABLE 3

| example | polyester[1)] (wt.-%) | TPE-E (wt.-%) | poly carbonate (wt.-%) | polymeric carbodiimide (wt.-%) | abrasion (μm) | remarks |
|---|---|---|---|---|---|---|
| V1 | 100 | — | — | — | 102 | 100% PET as comparision |
| V2 | 75 | 25 | — | — | 106 | |
| V3 | 74.5 | 25 | 0.5 | — | 96 | influence of |
| V4 | 74.2 | 25 | 0.8 | — | 90 | polycarbonate |
| V5 | 73.8 | 25 | 1.2 | — | 86 | |
| V6 | 73 | 25 | — | 2 | 95 | influence of |
| V7 | 71 | 25 | — | 4 | 87 | carbodiimide |
| V8 | 69 | 25 | — | 6 | 85 | |
| 4 | 70.5 | 25 | 0.5 | 4 | 44 | influence of |
| 5 | 70.2 | 25 | 0.8 | 4 | 42 | the combi- |
| 6 | 73.8 | 25 | 1.2 | 4 | 41 | nation of polycarbonate and carbodiimide |

[1)]polyethylene terephthalate PET was used in comparative example V1; polyester of the PET type 153 was used in the other comparative examples and in the examples in table 3.

The marked improvement in abrasion resistance by using the monofilaments of the invention is surprising. For the variants of the multi-layer forming fabrics according to the invention 41 to 44 μm abrasion were detected compared to 85 to 96 μm abrasion by using monofilaments stabilized only by polycarbonate or only by carbodiimide or 102 to 106 μm abrasion by using monofilaments consisting only of polyester.

The invention claimed is:

1. A polyester monofilament containing a) 60 to 85 wt. % of a polyester raw material selected from the group of polyethylene terephthalate, of polyethylene terephathalate modified with dicarboxylic acid, or combinations thereof, b) 14.4 to 30 wt. % of a thermoplastic elastomeric block copolymer selected from thermoplastic polyurethane elastomers and thermoplastic polyester elastomers, c) 0.05 to 10 wt. % of a polycarbonate, and d) 0.1 to 10 wt. % of a carbodiimide stabilizer, wherein the quantities are based on the total amount of the monofilament, wherein the monofilament exhibits improved abrasion resistance as compared to the same polyester monofilament having components a) and b) in the recited amounts prepared without both polycarbonate and carbodiimide stabilizers in the recited amounts.

2. The polyester monofilament according to claim 1, wherein component a) is a polyethylene terephthalate.

3. The polyester monofilament according to claim 1, wherein component a) is a polyethylene terephthalate modified with dicarboxylic acid.

4. The polyester monofilament according to claim 3, wherein the polyethylene terephtalate modified with aromatic dicarboxylic acid is a polyethylene terephthalate modified with isophthalic acid or a polyethylene terephthalate modified with phthalic acid.

5. The polyester monofilament according to claim 3, wherein the polyethylene terephtalate modified with aliphatic dicarboxylic acid is a polyethylene terephthalate modified with adipic acid or a polyethylene terephthalate modified with sebacic acid.

6. The polyester monofilament according to claim 1, wherein component b) is a thermoplastic polyester elastomer.

7. The polyester monofilament according to claim 1, wherein the monofilament exhibits improved abrasion resistance of at least 48% as compared to the same polyester monofilament having components a) and b) in the recited amounts prepared without both polycarbonate and carbodiimide stabilizers in the recited amounts when tested as the back weft of a multilayer forming fabric.

8. The polyester monofilament according to claim 1, wherein component c) is a polycarbonate that is derived from bisphenols.

9. The polyester monofilament according to claim 1, wherein component d) is a polymeric carbodiimide.

10. The polyester monofilament according to claim 1, wherein the monofilament contains besides components a) to d) in addition 0.001 to 10 wt. % of common additives e), selected from antioxidants, UV-stabilizers, fillers, pigments, biocides, additives for increasing the electrical conductivity, additives for increasing the abrasion resistance, friction reducing additives, avivages, processing aids, plasticizers, lubricants, matting agents, viscosity modifiers, crystallization promoters or combinations of two or more of these additives.

11. The polyester monofilament according to claim 1, wherein this contains component a) in an amount from 70 to 80 wt. %, component b) in an amount from 20 to 25 wt. %, component c) in an amount from 0.5 to 3 wt. % and component d) in an amount from 0.3 to 4.5 wt. %.

12. The polyester monofilament according to claim 1, wherein the monofilament comprises 70.5-79.1 wt. % of PET modified with 10 to 15 wt. % of isophthalic acid, 20-25 wt. % thermoplastic polyester elastomer, 0.5-2.5 wt. % of polycarbonate and 0.4-4.5 wt. % of polymeric carbodiimide.

13. A textile fabric comprising threads according to claim 1.

14. In paper manufacture, a method of of using the polyester monofilament according to claim 1, comprising incorporating the polyester filament into a paper machine clothing and utilizing the paper machine clothing used in a sheet formation section and/or in a dryer section of a paper machine.

15. The textile fabric according to claim 13, selected from a web, a knitted fabric, a mesh fabric or a laid fabric.

16. The polyester monofilament according to claim 1, wherein component b) is a thermoplastic polyester block-copolymer elastomer-comprising blocks of polybutylene terephthalate and blocks of polyethylene glycol terephthalate.

17. The polyester monofilament according to claim 1, wherein component c) is a polycarbonate that is derived from Bisphenol A.

18. The polyester monofilament according to claim 3, wherein component a) is a polyethylene terephthalate modified with aromatic dicarboxylic acid or a polyethylene terephthalate modified with aliphatic dicarboxylic acid.

19. The polyester monofilament according to claim 18, wherein component b) is a thermoplastic polyester elastomer.

20. A paper machine clothing, a conveyor belt or a filtration screen which comprises a polyester monofilament containing a) 60 to 85 wt. % of a polyester raw material selected from the group of polyethylene terephthalate, of polyethylene terephathalate modified with dicarboxylic acid, or combinations thereof, b) 14.4 to 30 wt. % of a thermoplastic elastomeric block copolymer selected from thermoplastic polyurethane elastomers and thermoplastic polyester elastomers, c) 0.05 to 10 wt. % of a polycarbonate, and d) 0.1 to 10 wt. % of a carbodiimide stabilizer, wherein the quantities are based on the total amount of the monofilament, wherein the monofilament exhibits improved abrasion resistance as compared to the same polyester monofilament having components a) and b) in the recited amounts prepared without both polycarbonate and carbodiimide stabilizers in the recited amounts.

21. A paper machine clothing, a conveyor belt or a filtration screen according to claim 20, which is a multilayer web including back weft monofilament containing a) 60 to 85 wt. % of a polyester raw material selected from the group of polyethylene terephthalate, of polyethylene terephathalate modified with dicarboxylic acid, or combinations thereof, b) 14.4 to 30 wt. % of a thermoplastic elastomeric block copolymer selected from thermoplastic polyurethane elastomers and thermoplastic polyester elastomers, c) 0.05 to 10 wt. % of a polycarbonate, and d) 0.1 to 10 wt. % of a carbodiimide stabilizer, wherein the quantities are based on the total amount of the monofilament, wherein the monofilament exhibits improved abrasion resistance as compared to the same polyester monofilament having components a) and b) in the recited amounts prepared without both polycarbonate and carbodiimide stabilizers in the recited amounts.

22. A paper machine clothing, a conveyor belt or a filtration screen according to claim 21, which is a multilayer web including back weft monofilament in which in the back weft monofilament consists of polyester monofilament containing a) 60 to 85 wt. % of a polyester raw material selected from the group of polyethylene terephthalate, of polyethylene terephathalate modified with dicarboxylic acid, or combinations thereof, b) 14.4 to 30 wt. % of a thermoplastic elastomeric block copolymer selected from thermoplastic polyurethane elastomers and thermoplastic polyester elastomers, c) 0.05 to 10 wt. % of a polycarbonate, and d) 0.1 to 10 wt. % of a carbodiimide stabilizer, wherein the quantities are based on the total amount of the monofilament, wherein the monofilament exhibits improved abrasion resistance as compared to the same polyester monofilament having components a) and b) in the recited amounts prepared without both polycarbonate and carbodiimide stabilizers in the recited amounts and wherein the multilayer fabric exhibits improved abrasion resistance of at least 48% as compared to the same fabric with back weft monofilament consisting of polyester monofilament having components a) and b) in the recited amounts prepared without both polycarbonate and carbodiimide stabilizers in the recited amounts when tested as the back weft of the multilayer fabric.

* * * * *